United States Patent [19]

Rys

[11] 4,135,135

[45] Jan. 16, 1979

[54] RESILIENT ANTI-REBOUND LATCH FOR CIRCUIT BREAKER CONTACTS

[75] Inventor: Tadeusz Rys, Bellefontaine, Ohio

[73] Assignee: Gould Inc., Rolling Meadows, Ill.

[21] Appl. No.: 817,359

[22] Filed: Jul. 20, 1977

[51] Int. Cl.[2] ..... H01H 75/00

[52] U.S. Cl. ..... 335/46; 335/157; 335/193

[58] Field of Search ..... 335/46, 157, 193, 271, 335/277

[56] References Cited

U.S. PATENT DOCUMENTS

| | | | |
|---|---|---|---|
| 2,932,706 | 4/1960 | Bodenschatz | 335/46 X |
| 3,072,764 | 1/1963 | Frink | 335/46 X |
| 3,263,042 | 7/1966 | Dyer et al. | 335/46 X |

*Primary Examiner*—George Harris

*Attorney, Agent, or Firm*—Ostrolenk, Faber, Gerb & Soffen

[57] ABSTRACT

A single pole molded case circuit breaker having a spring powered trip free contact operating mechanism including an extendable toggle connected at one end to a releasable cradle and connected at the other end to a movable contact, a latch for holding the cradle in reset position, and an automatic trip means for operating the latch to release the cradle upon the occurrence of predetermined overload conditions, is provided with anti-rebound means which prevents the movable contact from moving toward closed circuit position except under the influence of the operating mechanism. The anti-rebound means includes a single resilient member which is positioned to block the toggle from being extended unless the cradle is in its reset position.

10 Claims, 20 Drawing Figures

50
50a
50b
50c
50d
50A
51
52
55
56
57
62
64
83
94
97
47
47a
47b
47c
5A
5B

RESILIENT ANTI-REBOUND LATCH FOR CIRCUIT BREAKER CONTACTS

This invention relates to an improvement of the circuit breaker disclosed in the T. J. Rys copending application Ser. No. 703,078 filed July 6, 1976 for a Mounting Plate For Molded Case Circuit Breaker, and more particularly relates to means for preventing contact rebound toward closed position during automatic tripping.

Circuit breakers are often provided with anti-rebound means which prevent the movable contact from moving toward closed circuit position unless moved in this direction by the contact operating mechanism. Contact rebound is especially troublesome when very high fault currents are being interrupted in that rebound may result in reignition of the arc.

Typical prior art anti-rebound means include hooks, spring pins, hook pivot pins, biasing springs, latch reset cams, as well as other elements. All in all, prior art arrangements of this type have been excessively bulky and/or of complex construction thereby increasing the possibility of potential malfunction.

Pursuant to the instant invention an anti-rebound latch consists of a single resilient member which engages one of the toggle links to block extension of the toggle unless the releasable cradle is in reset position. The resilient member is mounted in a fixed position within the circuit breaker housing but is deflectable by the toggle during a tripping operation so as to permit collapse of the toggle. Resetting of the cradle after tripping repositions the toggle to permit the latter to be extended without interference by the resilient member.

Accordingly, a primary object of the instant invention is to provide a novel anti-rebound latch means for a circuit breaker.

Another object is to provide an anti-rebound latch means of this type that is of low cost.

Still another object is to provide an anti-rebound latch means of this type which is extremely compact.

A further object is to provide an anti-rebound latch means of this type which directly engages a collapsible toggle to prevent the latter from being extended toward contact closed position unless the toggle operating mechanism is in reset position.

These objects as well as other objects of this invention shall become readily apparent after reading the following description of the accompanying drawings in which:

In FIG. 11A the contacts are fully closed and in FIG. 11B the contacts are about to separate.

Figure 2:
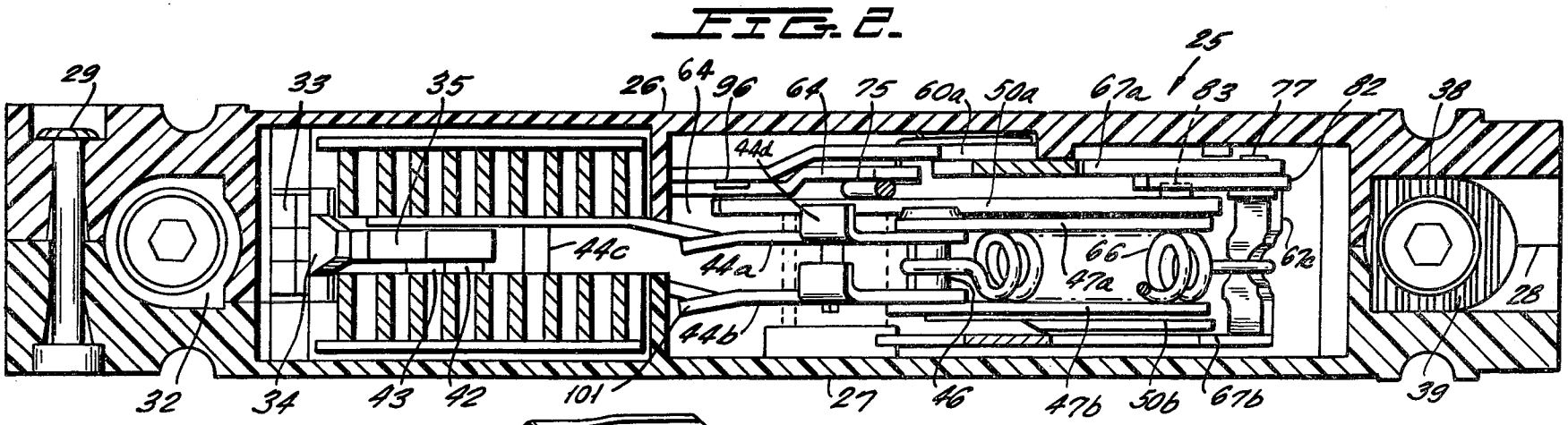
FIG. 2 is a longitudinal cross-section taken through line 2—2 of FIG. 1 looking in the direction of arrows 2—2.

Now referring to the Figures. Circuit breaker pole unit 25 is provided with a molded insulating housing consisting of sections 26, 27 which mate at line 28 (FIG. 2) and are secured together by rivets 29. The current carrying path through circuit breaker 25 extends from wire grip 32 at one end of load terminal strap 31 to stationary contact 33 at the other end of load terminal strap 31, movable contact 34 at one end of movable contact arm 35, through contact arm 35 and dual braid 36 connected to the other end of arm 35, through bimetal 37 to line terminal member 38 having wire grip 39 mounted thereon.

Thin insulating sheet 41 is interposed between movable contact arm 35 and load terminal strap 31 to electrically insulate these elements for a major portion of the length of contact arm 35. However, these elements are so close to one another that current limiting through contact blow-off is achieved by interaction of magnetic fields which accompany current flow in strap 31 and arm 35.

The lower end of contact arm 35 is pivotally mounted on a fixed pivot provided by pin 42 whose ends extend into recesses in both housing portions 26 and 27. Pin 43, located at a point between movable contact 34 and pin 42, connects contact arm 35 to one end of toggle link 44 having its other end connected by pin 46 to the other toggle member 47. Link 44 consists of two identical parallel arms 44*a*, 44*b* maintained spaced apart approximately the thickness of contact arm 35 by two spacers 44*c*. As seen in FIG. 5, toggle link 47 is a bifurcated element having parallel sections 47*a*, 47*b* joined by web 47*c*. Sections 47*a*, 47*b* are each provided with a V-notch 51 which receives a boss 52 on the inner surface of parallel walls 50*a*, 50*b* of cradle 50. Walls 50*a*, 50*b* are joined by web 50*c* and wall 50*a* is provided with latching tip extension 55 engageable by latching protrusion 56 of latch member 64. Ear 50*d* extends outward from wall 50*a* and engages an edge of pivoted interpole trip lever 500 near the end thereof remote from rectangular aperture 501. Extension 55 is engageable with protrusion 44*d* (FIG. 4) of toggle arm 44*a* to act as a kicker for separation of contacts 33, 34 should they tend to weld or otherwise stick closed during fault conditions.

Figure 6:
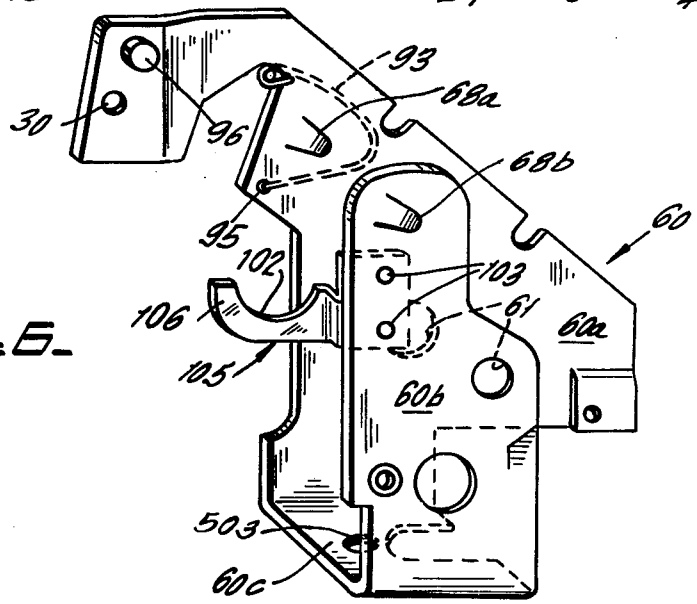
FIG. 6 is a perspective of the mounting plate for the contact operating mechanism.

Aligned apertures 57 in walls 50*a*, 50*b* receive pin 58 which pivotally mounts cradle 50 to formed mounting plate or frame 60 (FIG. 6) at aligned apertures 61 in main and auxiliary walls 60*a*, 60*b* of plate 60. Web section 60*c* connects walls 60*a*, 60*b* in spaced parallel relationship. Insulating screw 122 (FIG. 1) extends through a clearance aperture 502 in support strap 59 and is received by threaded aperture 503 in web 60*c* to secure mounting plate 60 to strap 59 with thin insulation 49 interposed therebetween. Embossment 62 of cradle 50 provides a narrow space between latching tip 55 and frame wall 60*a* for clearing the main planar portion of latch member 64. The latter is mounted on plate 60 by cantilevered pivot pin 65 at aperture 30 of wall 60*a*. Cantilevered latching protrusion 56 extends perpendicular to the main planar portion of member 64. V-shaped wire spring 93 (FIG. 6), positioned against the outer surface of plate wall 60*a*, has its end extending into aperture 94 in latch 64 and aperture 95 in wall 60*a* to bias latch 64 counterclockwise with respect to FIG. 1 against inward protrusion of wall 60*a*.

Figures 7, 8, 8A, 9, 9A:
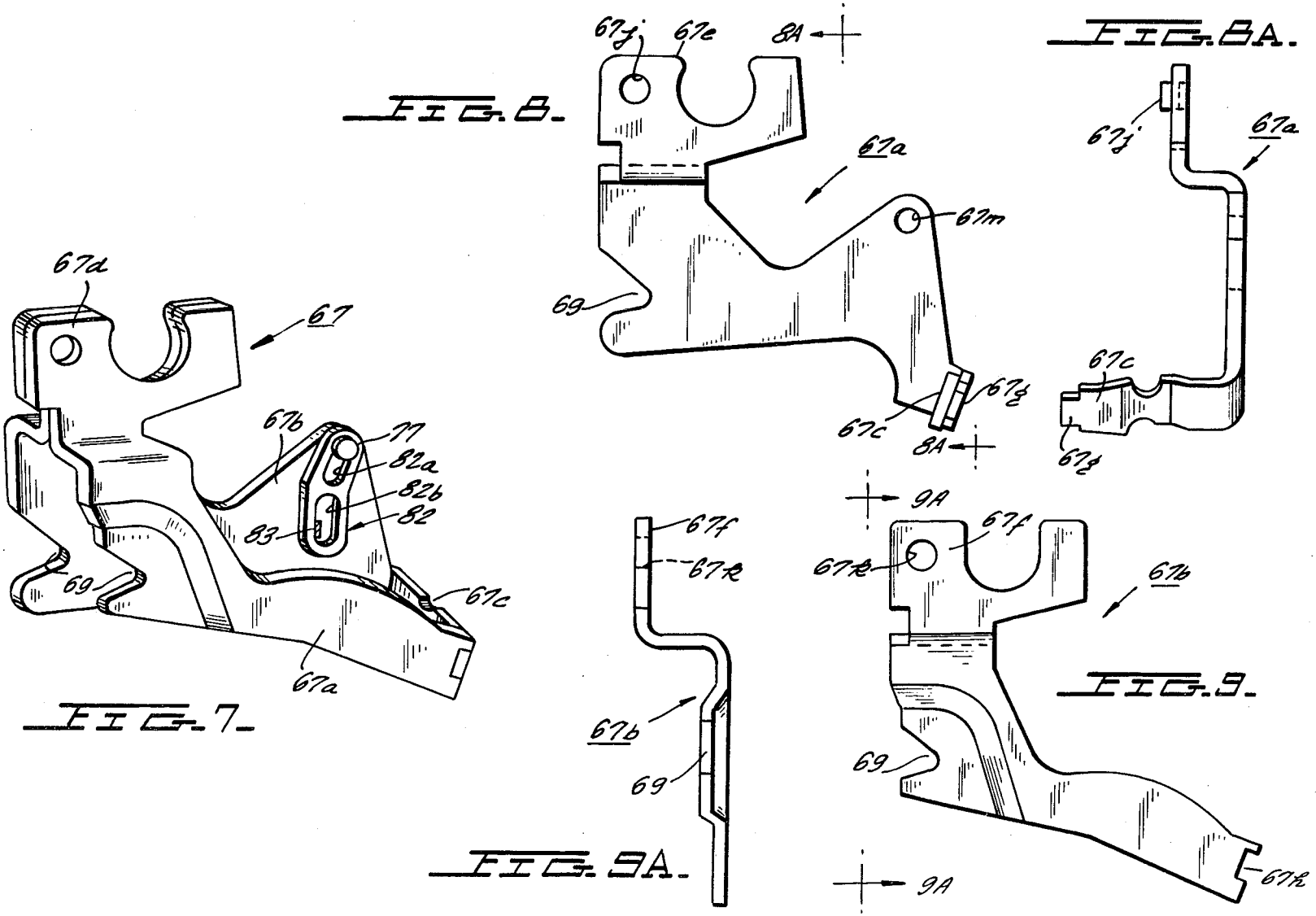
FIG. 7 is a perspective of the mechanism operating member and reset link assembled thereto.
FIG. 8 is a side elevation of one section of the operating member.
FIG. 8A is an elevation of the operating member section of FIG. 8 looking in the direction of arrows 8A—8A of FIG. 8.
FIG. 9 is a side elevation of the other section of the operating member.
FIG. 9A is a side elevation of the operating member section of FIG. 9 looking in the directions of arrows 9A—9A of FIG. 9.
Figure 10:
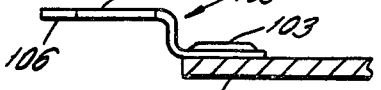
FIG. 10 is an edge view of the anti-rebound latch member and its mounting, looking in the direction of arrows 10—10 of FIG. 3.

Main operating spring 66 (FIG. 2) is a coiled tension member connected at one of its ends to toggle knee pin 46 and at the other of its ends to operating member 67 at connecting section 67*c* between spaced main walls of operating member sections 67*a*, 67*b* (FIGS. 8 and 9). The upper ends 67*e*, 67*f* of the respective sections 67*a*, 67*b* are offset inwardly, abut one another and are secured together to constitute extension 67*d*. Positioning between sections 67*a*, 67*b* is achieved by tip 67*g* of section 67*c* entered into notch 67*h* of section 67*b* and embossment 67*j* of end 67*e* entered into aperture 67*k* of end 67*f*. Member 67 is pivotally mounted between walls 60*a*, 60*b* of mounting member 60 at inward bearing projections 68*a*, 68*b* which extend into aligned V-notches 69 in walls 67*a*, 67*b* of member 67. Upper extension 67*d* of operating member 67 extends into a complementary recess in the lower surface of handle member 72. The latter includes extension or handle 73 which projects through housing opening 74 so that handle 73 is engageable for manual operation of circuit breaker 25.

Formed wire link 75 connects latch member 64 at aperture 97 thereof to trip member 76 at a point intermediate the ends of the latter. Member 76 is pivotally mounted at one of its ends to mounting member 60 by pin 78.

Figure 1:
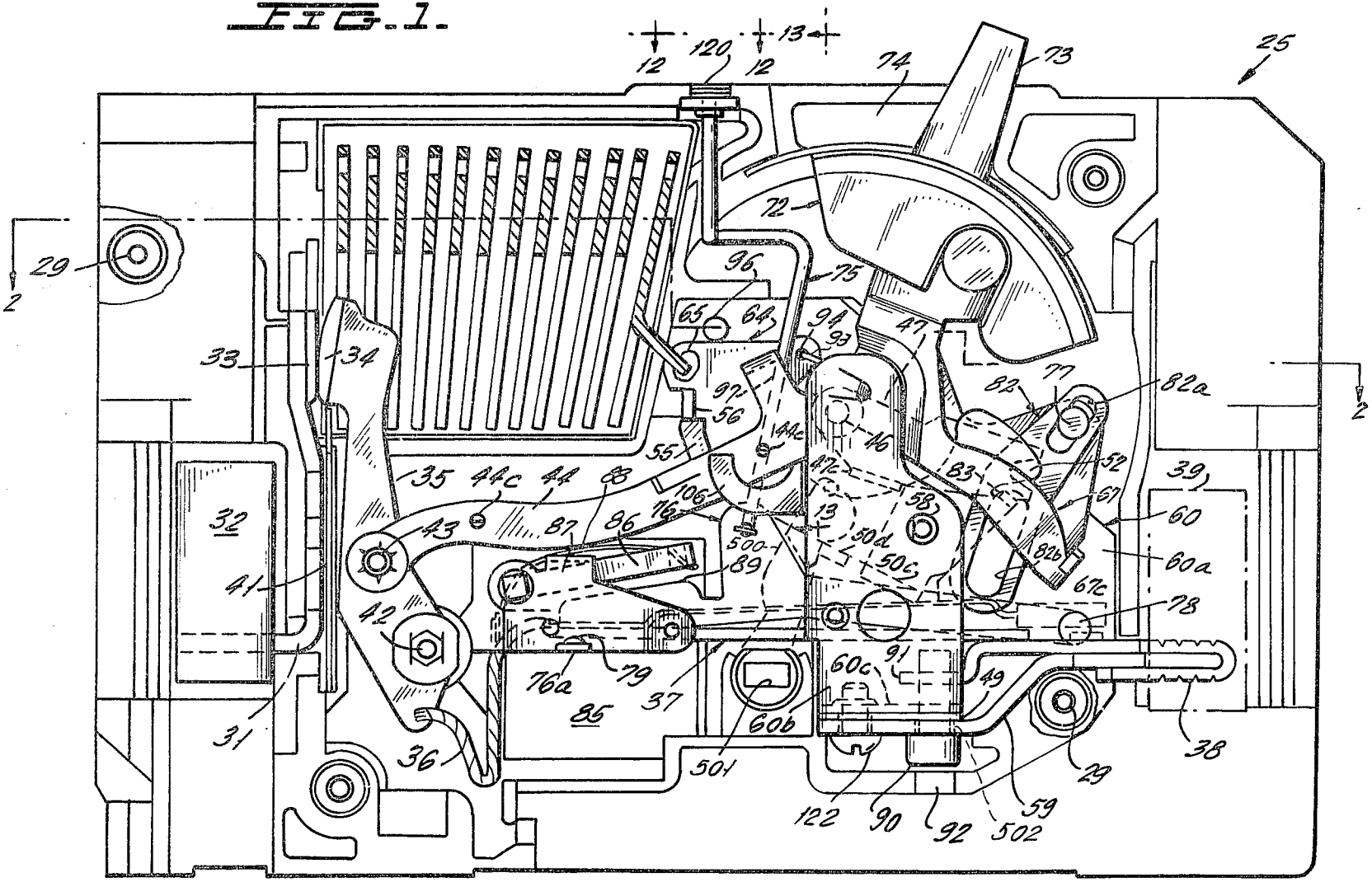
FIG. 1 is a side elevation of a single pole circuit breaker constructed in accordance with the instant invention with the contacts closed and the near housing half removed to reveal the operating elements.

As seen in FIG. 1, the right end of the bimetal 37 is fixedly secured to line terminal member 38 and the free end of bimetal 37 is aligned with trip member protrusion 79. Upon heating of bimetal 37 due to abnormal current conditions existing for an extended period of time, the free end of bimetal 37 deflects and engages protrusion 79 on ear 76*a* projecting perpendicular to the main portion of trip member 76. This pivots trip member 76 counterclockwise with respect to FIG. 1 and moves link 75 downward to pivot latch member 64 clockwise, whereby latch 56 releases cradle tip 55. Now, under the influence of main operating spring 66 cradle 50 pivots clockwise and moves pivots 52 at the right end of toggle 44, 47 below the line of action of spring 66 so that the latter is effective to move toggle knee 46 rapidly to the right with respect to FIG. 1 causing contact arm 35 to pivot clockwise and separate movable contact 34 from stationary contact 33.

Calibrating screw 90, passing through a clearance aperture in strap 59 and threadably engaged with offset 91 of terminal member 38, is accessible for operation at housing aperture 92. By rotating screw 90 member 38 is bent thereby repositioning the free end of bimetal 37 to set the thermal trip calibration by adjusting the gap between the free end of bimetal 37 and protrusion 79 of trip member 76.

To reset cradle 50, handle 73 is moved to the left with respect to FIG. 1 together with pin 77 which extends through slot 82*a* in reset link 82 to pivotally connect link 82 to operating member 67 at aperture 67*m* (FIG. 8) thereof. Outwardly projecting ear 83 of cradle wall 50*a* extends into slot-like window 82*b* of link 82 to operatively connect cradle 50 to member 67. Thus, as handle 73 moves to the left cradle 50 moves counterclockwise until latch tip 55 falls below latch 56. Subsequent movement of handle 73 to the right with respect to FIG. 1 moves the right end of spring 66 downward until its line of action is below pivots 52 at the right end of toggle 44, 47 at which point spring 66 moves toggle knee 46 downward. This extends toggle 44, 47 thereby moving contact 34 into engagement with contact 33. For manually opening, circuit breaker 25 handle 73 is moved to the left with respect to FIG. 1 and in so doing the right end of spring 66 is moved above pivots 52 at the right end of toggle 44, 47 so that the line of action of spring 66 is then directed to collapse toggle 44, 47 and separate movable contact 34 from stationary contact 33.

In addition to thermal trip means provided by bimetal 37, circuit breaker 25 also includes magnetic or instantaneous trip means comprising movable armature plate 86 and stationary U-shaped yoke 85 having arms between which bimetal 37 extends. The left or pivot edge of plate 86 is captured by cap member 87 and the right edge of plate 86 is biased upwardly by spring 88. When armature 86 is attracted to yoke 85 during occurrences of fault current in excess of a predetermined magnitude, armature 86 engages edge formation 89 on trip member 76 to pivot the latter counterclockwise. This draws link 75 downward to trip latch plate 64 and release cradle 50.

Figure 3:
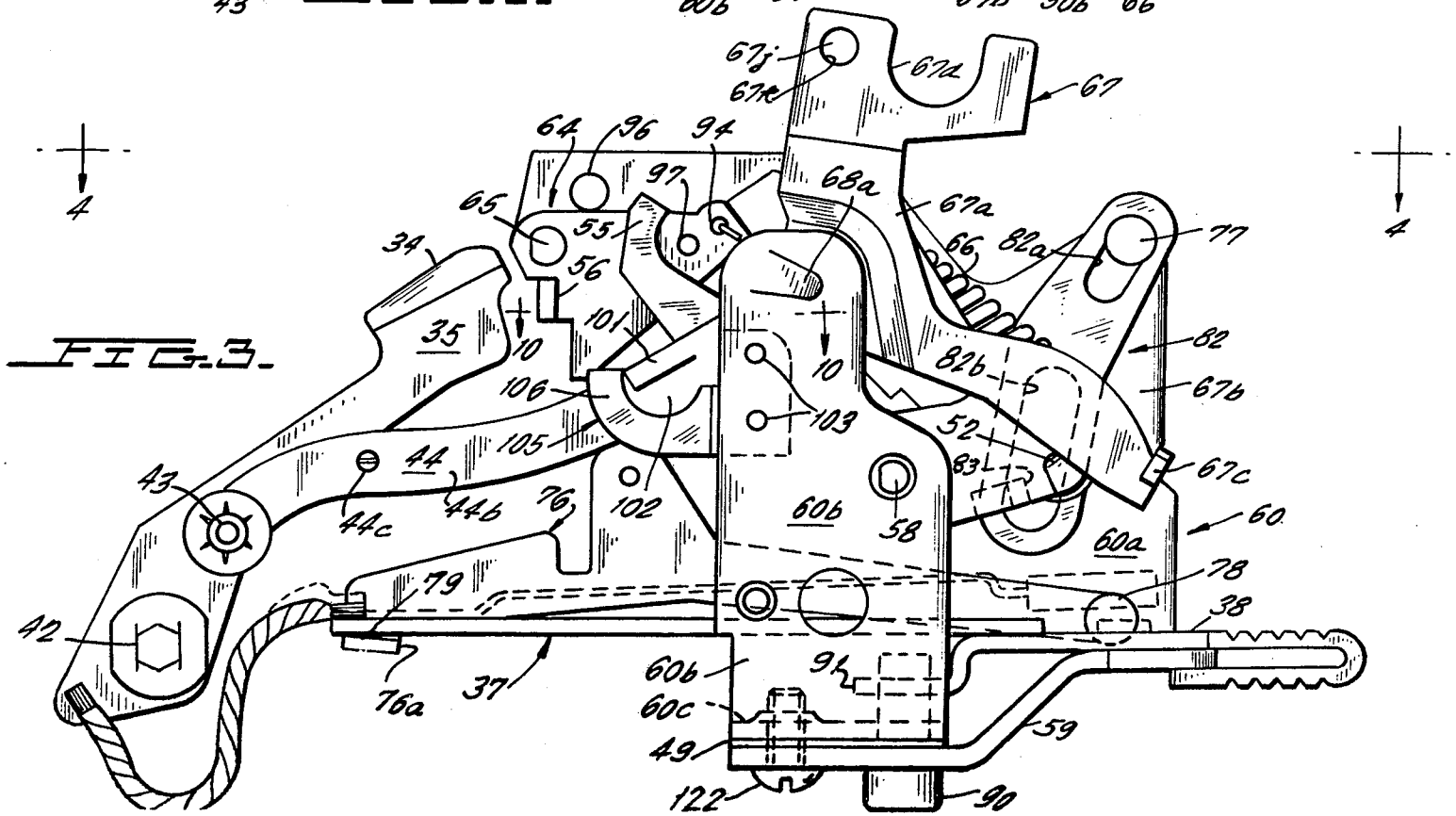
FIG. 3 is a side elevation of the contact operating mechanism in its tripped position.

It is noted that when operating member 67 is pivoted from right to left with respect to FIG. 3 for resetting cradle 50, there is substantial upward movement of pin 77 which connects reset link 82 to operating member 67. Similarly, as cradle 50 is pivoted counterclockwise toward its reset position there is substantial upward movement of reset ear 83. The provision of reset link 82 substantially reduces friction forces operating between operating member 67 and cradle 50 during resetting of the latter. That is, during resetting, to a great extent link 82 moves upward to impart upward movement to reset ear 83. When movements of ear 83 and pivot pin 77 do not coincide, the pivotal mounting of reset link 82 acts to compensate for this effect without the necessity of overcoming large friction forces.

Figure 4:
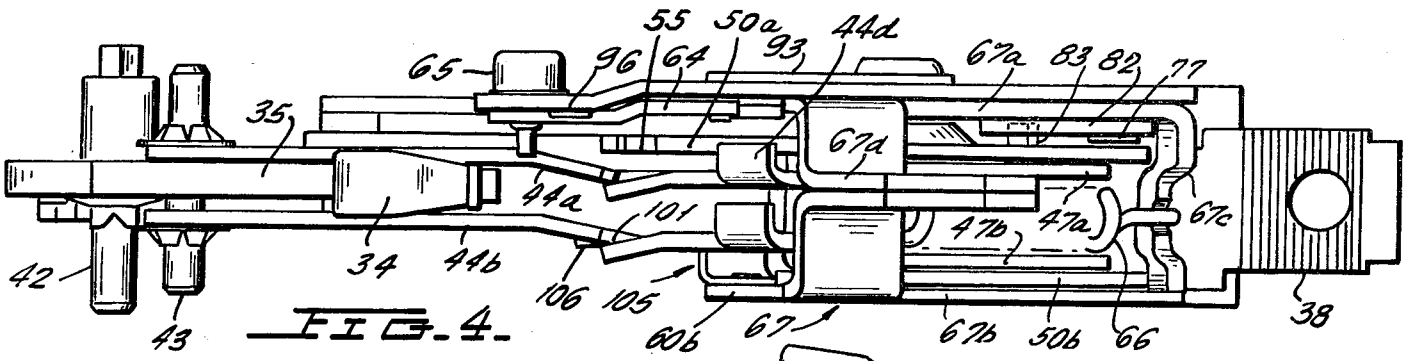
FIG. 4 is a plan view of the mechanism of FIG. 3 looking in the direction of arrows 4—4 of FIG. 3.
Figures 5, 5A, 5B, 5C:
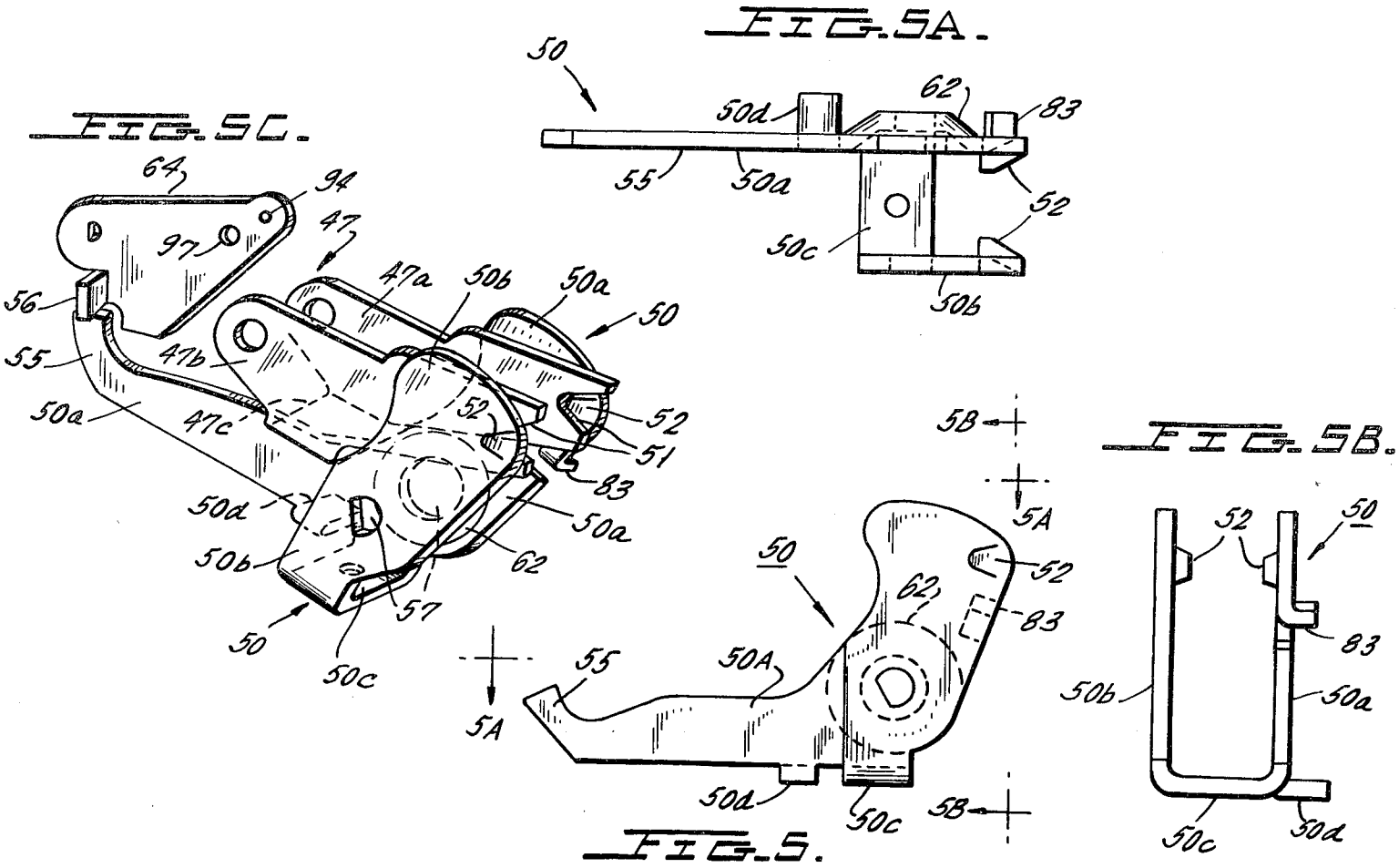
FIG. 5 is a side elevation of the releasable cradle of the contact operating mechanism.
FIGS. 5A and 5B are elevations of the cradle looking in the directions of the respective arrows 5A—5A and 5B—5B of FIG. 5.
FIG. 5C is a perspective showing the cradle and one of the toggle links pivotally connected thereto.

As seen best in FIGS. 3 and 4, each of the sections 44*a*, 44*b* of toggle link 44 is provided with a protrusion 101 which, when the mechanism is in the tripped position of FIG. 3, is positioned within semicircular notch 102 at the free end 106 of anti-rebound latch member 105. The latter is constructed of a thin sheet of resilient material, such as phosphor bronze, and is fixedly secured to wall 60*b* of mounting plate 60 by providing the latter with circular embossments at locations 103, 103 which are entered into circular apertures (not shown) in member 105. Then these embossments are spread over the boundaries of the apertures in member 105.

When cradle 50 is pivoted about pin 58 in a counterclockwise direction from the tripped position of FIG. 3 to the reset position of FIG. 1 pivot 52 has a substantial upward component of movement thereby forcing toggle knee 46 upward with respect to FIG. 3 and in so doing lifting protrusion 101 from notch 102 through the upper open end thereof. Now protrusion 101 is clear of latch member 105 when contact arm 35 moves toward the closed circuit position of FIG. 1. Upon the occurrence of a fault current condition causing latch member 64 to release cradle 50, toggle pivots 52 will move toward the trip position of FIG. 3 and latch member 105 will intercept protrusion 101 of toggle link section **44*b* as toggle 44, 47 collapses. However, projection 101 is disposed at an angle with respect to member 105, and since the latter is constructed of resilient material projection 101 acts to cam end portion 106 away from link 44 to permit complete collapse of toggle 44, 47. As soon as projection 101 is aligned with notch 102, member 105 springs back to its normal holding position of FIGS. 3 and 4. Should contact arm 35 then attempt to rebound toward closed circuit position the left edge of projection 101 will be engaged by member 105 to block further movement of toggle link 44, thereby preventing movable contact arm 35** from moving toward closed circuit position.

Figure 11B:
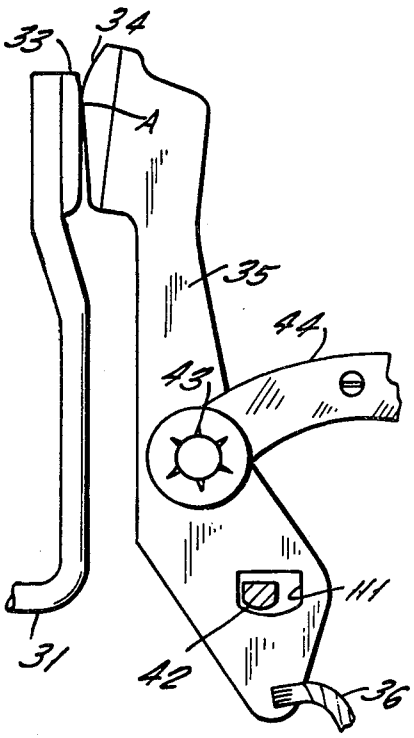
FIGS. 11A and 11B are side elevations of the cooperating contacts and movable contact arm.
Figure 11A:
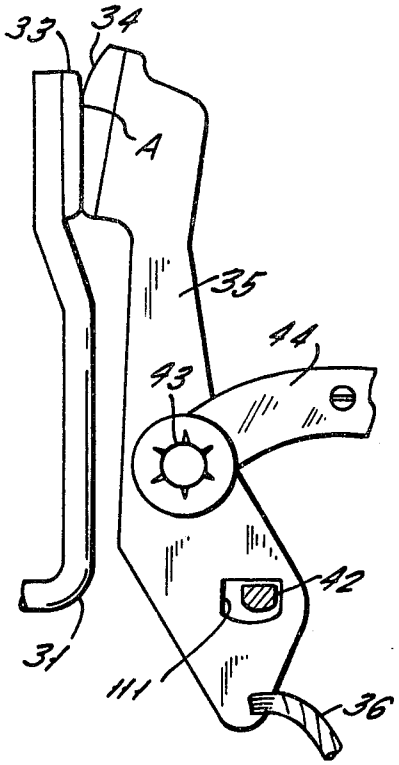

Now referring more particularly to FIGS. 11A and 11B. In order to facilitate the breaking of welds that may form between separable cooperating contacts 33, 34, pursuant to the instant invention the pivot for contact arm 35 is provided by pin 42 extending through elongated slot 111 at the end of movable contact arm 35 remote from movable contact 34. For purposes of this invention, pivot pin 42 is referred to as being stationary in that the bearing formation in housing sections 26, 27 which receive the end of pivot pin 42 limits pin 42 to essentially rotary motion. Pin 42 extends through elongated aperture 111 whose width is only slightly greater than the largest cross-sectional dimension of pin 42 taken perpendicular to the flat thereof. However, the length of slot 111 is much greater than the diameter of pin 42 to achieve a prying action that facilitates separation of contacts 33, 34.

More particularly, conventionally pin 42 would be closely fitted within an aperture of contact arm 35. In this event the opening force to separate contacts 33, 34 would be only about one third the toggle force acting at toggle connecting point 43 in that the distance between pivot 42 and point 43 is approximately one third the distance between pivot 42 and the engaging point A between contacts 33, 34.

When elongated slot 111 is provided, when circuit breaker 25 is closed (FIG. 11A) the right end of slot 111 bears against pin 42. And opening force applied at connecting point 43 will move the latter to the right from the position of FIG. 11A to that of FIG. 11B wherein the left boundary of slot 111 bears against pin 42 (FIG. 11B). In moving between the positions of FIGS. 11A and 11B contact arm 35 pivots counterclockwise about contact engaging point A a levered prying action is applied to peel contact 34 from contact 33 to break welds that may have formed between contacts 33, 34.

Figure 12:
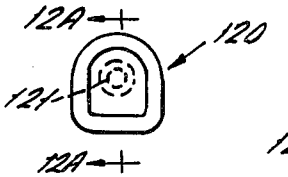
FIG. 12 is a plan view of the push-to-trip button looking in the direction of arrows 12—12 of FIG. 1.
Figure 12A:
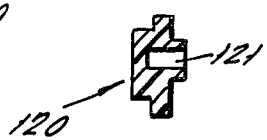
FIG. 12A is a cross-section taken through line 12A—12A of FIG. 12 looking in the direction of arrows 12A—12A.
Figure 13:
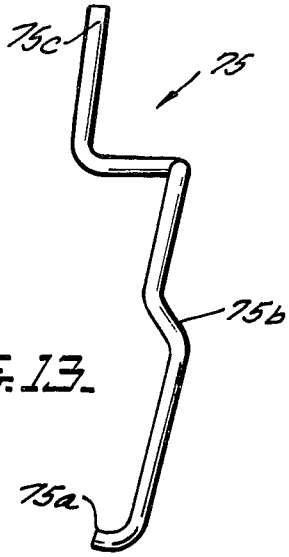
FIG. 13 is a side elevation looking in the direction of arrows 13—13 of FIG. 1 showing the formed wire link connecting the button of FIG. 12 with the main latch of the contact operating mechanism.

Now referring more particularly to FIGS. 1, 12 and 13, it is seen that wire link 75 is formed with offset **75*a* at its lower end to operatively engage trip member 76. At a point intermediate the ends thereof, link 75 operatively engages latch member 64 by means of offset section 75*b*. The upper end 75*c* of link 75 extends into aperture 121 in the lower surface of plastic pushbutton 120 whose upper surface is accessible at the front of circuit breaker housing 26, 27 adjacent to aperture 74 through which manual operating handle 73 extends. Spring 93 biases latch member 64 in a counterclockwise direction with respect to FIG. 1. This biases link 75 upward to normally maintain the upper surface of pushbutton 120 essentially flush with the upper surface of circuit breaker housing 26, 27. By merely depressing button 120 link 75 is forced downward thereby pivoting latch member 64 clockwise to move to its tripped position for automatic opening of circuit breaker contacts 33, 34**.

Although there has been described a preferred embodiment of this invention, many variations and modifications will now be apparent to those skilled in the art. Therefore, this invention is to be limited, not by the specific disclosure herein, but only by the appended claims.

What is claimed is:

1. A circuit breaker including separable cooperating contact means, a spring powered trip-free mechanism for opening and closing said contact means; said mechanism including a releasable cradle biased toward a tripped position wherein said mechanism is ineffective to close said contact means, and a trip latch for normally maintaining the cradle in a reset position wherein said mechanism is operable to close said contact means; automatic trip means responsive to predetermined abnormal current conditions to trip said trip latch thereby releasing said cradle for movement to a trip position; a housing wherein the circuit breaker elements previously recited are disposed; antirebound latch means including a deflectable means fixedly mounted in said housing and operatively positioned and biased so as normally to be in a first path along which a movable portion of said mechanism moves when said cradle is in said trip position; said deflectable means when in its normal position blocking movement of said movable portion along said first path in contact closing direction; during movement of said movable portion along said first path in contact opening direction said movable portion engaging said deflectable means and deflecting same away from said first path to which the latch automatically returns after the movable portions move past; said cradle when in said reset position repositioning said movable portion so as to move along a second path in contact opening and closing directions, said deflectable means being remote from said second path.

2. A circuit breaker as set forth in claim 1 in which the deflectable means is a resilient member constructed of sheet material.

3. A circuit breaker as set forth in claim 1 in which the mechanism also includes a toggle connected between the contact means and the cradle; said contact means being closed by extending said toggle; said movable portion being on said toggle.

4. A circuit breaker as set forth in claim 3 in which the movable portion projects from a side of said toggle.

5. A circuit breaker as set forth in claim 4 in which the deflectable means is a resilient member constructed of sheet material.

6. A circuit breaker as set forth in claim 4 in which the movble portion is formed integrally with a first link of said toggle.

7. A circuit breaker as set forth in claim 3 in which the toggle includes first and second links pivotally joined at a knee; said first link also connected to said contact means and said second link also connected to said cradle; said movable portion being on said first link.

8. A circuit breaker as set forth in claim 7 in which the deflectable means is a resilient member constructed of sheet material.

9. A circuit breaker as set forth in claim 2 in which the resilient member includes a notch having an opening along an edge of the resilient member; said movable portion being disposed in said notch when the cradle is in its said tripped position and being moved out of said notch through said opening to said second path.

10. A circuit breaker as set forth in claim 9 in which the resilient member is secured in said housing along another edge thereof adjacent said edge having said opening.

* * * * *

UNITED STATES PATENT AND TRADEMARK OFFICE

CERTIFICATE OF CORRECTION

PATENT NO. : 4,135,135
DATED : January 16, 1979
INVENTOR(S) : Tadeusz Rys

It is certified that error appears in the above—identified patent and that said Letters Patent is hereby corrected as shown below:

Column 6, line 34 - "a trip" should read --said tripped--

Column 6, line 41 - "trip" should read --tripped--

Column 6, line 47 - "latch" should read --deflectable means--

Column 6, line 50 - "as to move" should read --that the latter moves--

Signed and Sealed this

*Twentieth* Day of *July 1982*

[SEAL]

*Attest:*

GERALD J. MOSSINGHOFF

*Attesting Officer*

*Commissioner of Patents and Trademarks*